US008072414B2

(12) United States Patent
Yu et al.

(10) Patent No.: US 8,072,414 B2
(45) Date of Patent: Dec. 6, 2011

(54) DISPLAY METHOD ON ACTIVE MATRIX DISPLAY

(75) Inventors: Chun-Kuo Yu, Taoyuan County (TW); Chien-Ping Ku, Taoyuan County (TW); Chih-Fan Su, Kaohsiung County (TW)

(73) Assignee: Chunghwa Picture Tubes, Ltd., Bade, Taoyuan (TW)

( * ) Notice: Subject to any disclaimer, the term of this patent is extended or adjusted under 35 U.S.C. 154(b) by 386 days.

(21) Appl. No.: 12/505,536

(22) Filed: Jul. 20, 2009

(65) Prior Publication Data

US 2010/0231496 A1 Sep. 16, 2010

(30) Foreign Application Priority Data

Mar. 12, 2009 (TW) ..... 98108024 A

(51) Int. Cl.
*G09G 3/36* (2006.01)

(52) U.S. Cl. ..... 345/103; 345/99

(58) Field of Classification Search ..... 345/103, 345/89, 98–100, 690
See application file for complete search history.

(56) References Cited

U.S. PATENT DOCUMENTS

| | | | | |
|---|---|---|---|---|
| 5,539,841 | A * | 7/1996 | Huttenlocher et al. | 382/218 |
| 5,767,911 | A * | 6/1998 | Boon | 375/240.12 |
| 6,473,077 | B1 | 10/2002 | Takenaka | |
| 7,161,568 | B2 | 1/2007 | Park | |
| 7,215,333 | B2 | 5/2007 | Chen | |
| 7,355,580 | B2 | 4/2008 | Shen | |
| 7,365,726 | B2 | 4/2008 | Tai | |
| 2006/0256238 | A1 * | 11/2006 | Mishima et al. | 348/459 |
| 2007/0189721 | A1 * | 8/2007 | Nakase | 386/95 |
| 2009/0102935 | A1 * | 4/2009 | Hung et al. | 348/222.1 |

FOREIGN PATENT DOCUMENTS

TW I295051 3/2008

* cited by examiner

*Primary Examiner* — Ricardo L Osorio
(74) *Attorney, Agent, or Firm* — Winston Hsu; Scott Margo

(57) ABSTRACT

The present invention provides a display method of an active matrix display. First, image data is provided, and the image data is divided into a first image section and a second image section. Next, a first black frame section and a second black frame section are respectively inserted into the first image section and the second image section to form a first frame and a second frame. Then, the first frame and the second frame are displayed in turn so as to display the image data.

15 Claims, 11 Drawing Sheets

DISPLAY METHOD ON ACTIVE MATRIX DISPLAY

BACKGROUND OF THE INVENTION

1. Field of the Invention

The present invention relates to a display method on an active matrix display, and more particularly, to a display method of inserting black frames.

2. Description of the Prior Art

Due to the fact that liquid crystal displays have advantages of light weight, small size and low power consumption, they are widely used in various display products. In addition, the liquid crystal displays utilizes orientations of liquid crystal molecules to control quantity of light passing through a liquid crystal layer of the liquid crystal display so as to display different grey levels. However, the liquid crystal is a material with adhesion, so that the response time of the liquid crystal display is longer. The liquid crystal display utilizes a Hold-type driving method, so that problems of motion blur and image residue are generated when the liquid crystal displays display moving images.

In order to solve the problems of motion blur and image residue, the prior art liquid crystal display utilizes a black frame insertion technology that inserts black frames between the frames, to solve the problems. Please refer to FIGS. 1A, 1B and 1C, which are display methods on a liquid crystal display according to the prior art. As shown in FIG. 1A, a motion image data is composed of a frame 1, a frame 2, a frame 3, and a frame 4 in sequence. In order to solve the problems of motion blur and image residue generated in displaying the motion image data, black frames 11, 12, 13 are respectively inserted between the frame 1 and the frame 2, between the frame 2 and frame 3, and between the frame 3 and frame 4. Meanwhile, the states of a backlight of the liquid crystal display for providing the display light source during the time intervals of displaying the frames 1, 2, 3, 4 and the black frames 11, 12, 13 are all in on states 14, 15, 16, 17, 18, 19, 20.

As shown in FIG. 1B, the motion image data is composed of a frame 1, a frame 2, a frame 3, a frame 4, a frame 5, a frame 6 and a frame 7 in sequence. This display method of FIG. 1B is to turn off the backlight during displaying the frame 2, the frame 4 and the frame 6, so that the backlight is in off states 22, 24, 26. During displaying the frame 1, the frame 3, the frame 5 and the frame 7, the backlight are in on states 21, 23, 25, 27. In other words, this display method utilizes turning off the backlight to insert the back frames.

As shown in FIG. 1C, the motion image data is composed of a frame 1, a frame 2, a frame 3 and a frame 4 in sequence. This display method of FIG. 1C inserts black frames 11, 12, 13 respectively between the frame 1 and the frame 2, between the frame 2 and the frame 3 and between the frame 3 and the frame 4, and turns off the backlight during displaying the black frames 11, 12, 13, so that the backlight is in off states 22, 24, 26. During displaying the frame 1, the frame 2, the frame 3 and the frame 4, the backlight is in on states 21, 23, 25, 27. In other words, this method utilizes inserting the black frames and turning off the backlight to solve the problems of motion blur and image residue. However, to insert black frames between the adjacent frames lowers the brightness of the motion images so as to generate the phenomenon of motion image flicker.

Therefore, to provide a display method without further consuming cost and with solving the problems of the motion image flicker, motion blur and image residue is an objective that the industry requires to achieve.

SUMMARY OF THE INVENTION

It is therefore a primary objective to provide a display method on an active matrix display so as to solve the problems of motion image flicker, motion blur and image residue.

According to an embodiment of the present invention, a display method on an active matrix display is provided. First, image data is provided, and the image data includes a plurality of pixel data rows. Each pixel data row corresponds to a scanning signal. Then, the image data is divided into a first image section and a second image section. At least one of the pixel data rows comprises a first pixel data segment and a second pixel data segment. The first pixel data segment is located in the first image section, and the second pixel data segment is located in the second image section. Next, a first black frame section and a second black frame section are respectively inserted into the first image section and the second image section, so that the first image section and the first black frame section form a first frame, and the second image section and the second black frame section form a second frame. The first black frame section and the second image section are located in a same display section, and the second black frame section and the first image section are located in a same display section. Thereafter, the first frame is displayed, and then, the second frame is displayed, so that the image data is displayed.

The present invention utilizes the timing controller to divide the image data into image sections and to insert the black frame sections respectively into the image sections so as to respectively form a frame. Then, each frame is displayed in turn. Therefore, the frame being displayed include a image section with brightness and a black frame section without brightness so as to reduce the overly large difference in brightness between the two adjacent frames, and the problems of motion image flicker, motion blur and image residue can be solved.

These and other objectives of the present invention will no doubt become obvious to those of ordinary skill in the art after reading the following detailed description of the preferred embodiment that is illustrated in the various figures and drawings.

DETAILED DESCRIPTION

Certain terms are used throughout the following description and claims to refer to particular components. As one skilled in the art will appreciate, manufacturers may refer to a component by different names. This document does not intend to distinguish between components that differ in name but in function. In the following discussion and in the claims, the terms "include", "including", "comprise", and "comprising" are used in an open-ended fashion, and thus should be interpreted to mean "including, but not limited to . . . " The terms "electrically connect" and "electrically connected" are intended to mean either an indirect or a direct electrical connection. Thus, if a first device electrically connects a second device, that connection may be through a direct electrical connection, or through an indirect electrical connection via other devices and connections.

Figure 1A:
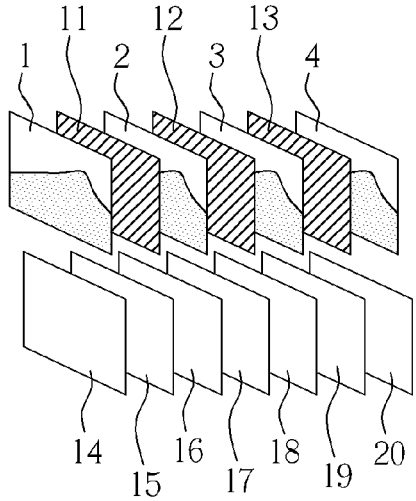
FIG. 1A PRIOR ART
FIGS. 1A, 1B and 1C are display methods on a liquid crystal display according to the prior art.
Figure 1B:
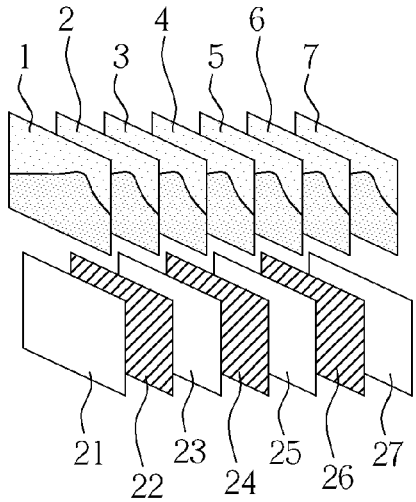
FIG. 1B PRIOR ART
Figure 1C:
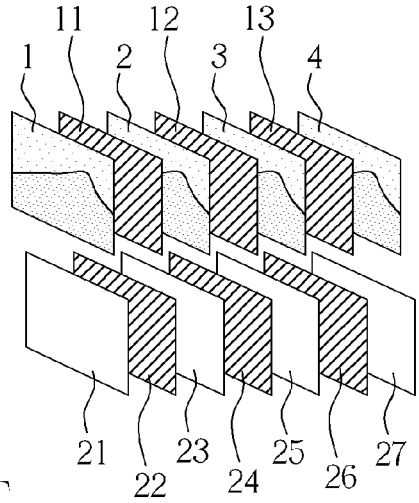
FIG. 1C PRIOR ART
Figure 2:
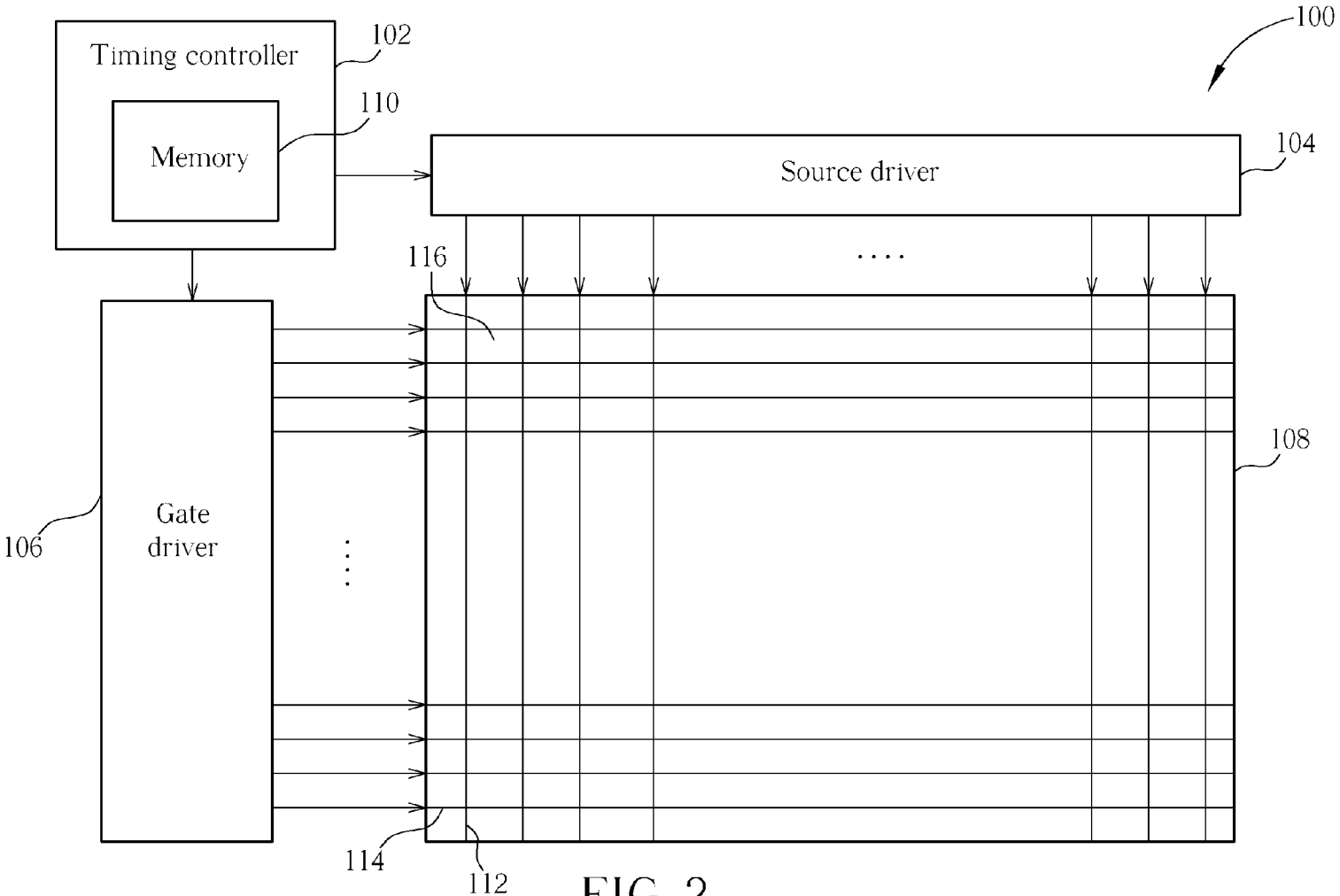
FIG. 2 is a schematic diagram illustrating a structure of an active matrix display according to the present invention.
Figure 3:
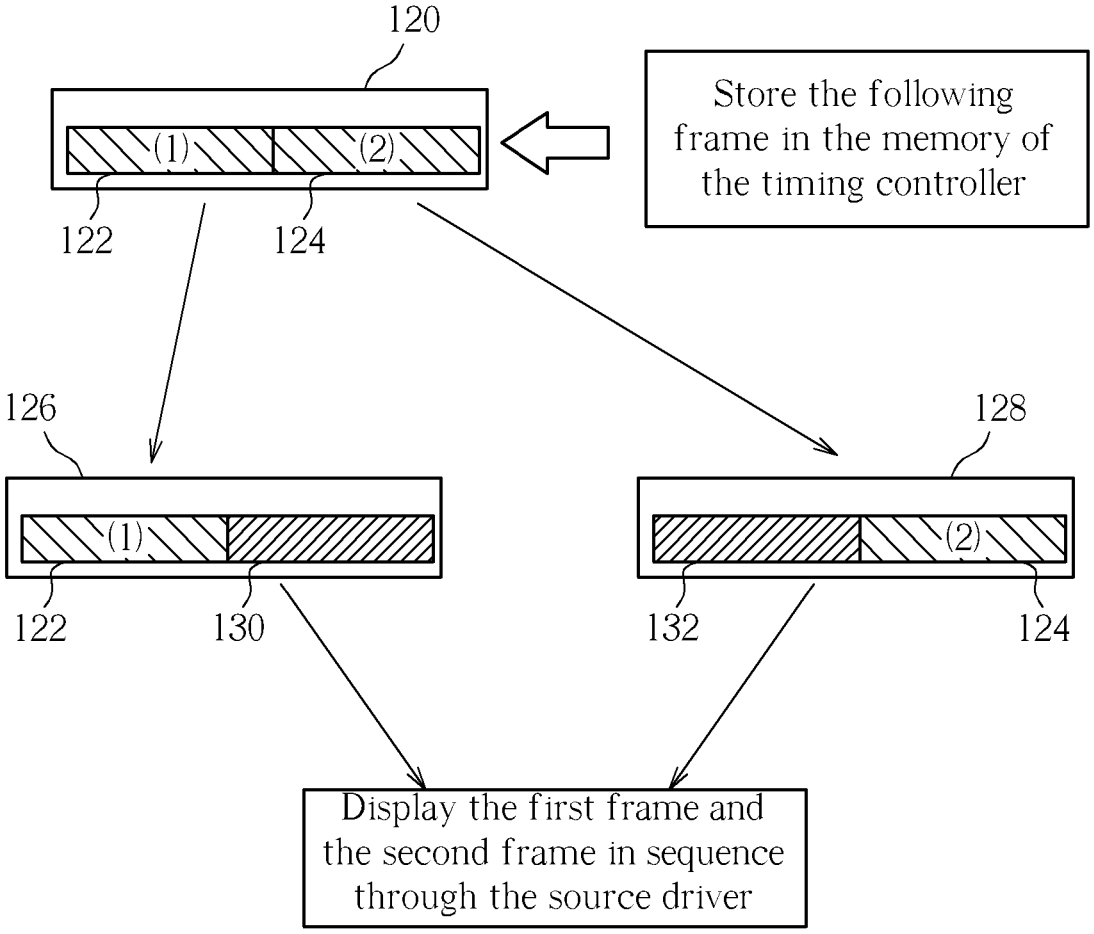
FIG. 3 is a schematic diagram illustrating a display method according to a first embodiment of the present invention.
Figure 4:
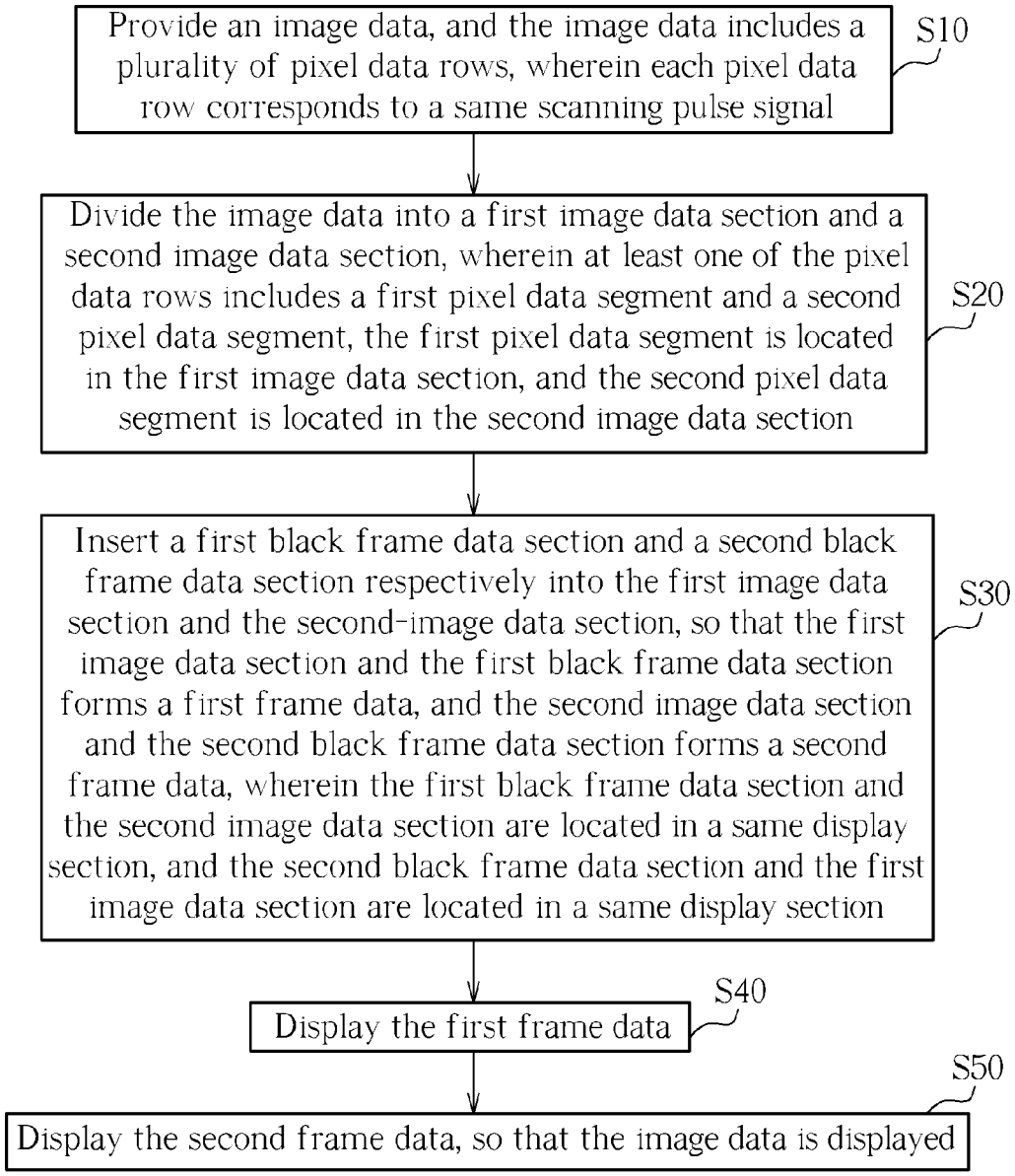
FIG. 4 is a flow chart illustrating the display method on the active matrix display according to the first embodiment of the present invention.

Refer to FIG. 2, FIG. 3 and FIG. 4. FIG. 2 is a schematic diagram illustrating a structure of an active matrix display according to the present invention. FIG. 3 is a schematic diagram illustrating a display method according to a first embodiment of the present invention. FIG. 4 is a flow chart illustrating the display method on the active matrix display according to the first embodiment of the present invention. As shown in FIG. 2, the active matrix display 100 includes a timing controller 102, a source driver 104, a gate driver 106, and a display panel 108. The source driver 104 and the gate driver 106 are respectively electrically connected to the timing controller 102 and the display panel 108, and the timing controller 102 includes a memory 110. In addition, the display panel 108 includes a plurality of data lines 112 and a plurality of gate lines 114. Each data line 112 is respectively electrically connected to the source driver 104, and each gate line 114 is respectively electrically connected to the gate driver 106. Two adjacent data lines 112 and two adjacent gate lines 114 define a pixel 116 for displaying a pixel data.

As shown in FIG. 3, the display method of this embodiment divides image data into a first image section 122 and a second image section 124. Then, the first image section 122 and the second image section 124 are respectively located in a first frame 126 and a second frame 128. A first black frame section 130 is inserted into the first frame 126, and a second black frame section 132 is inserted into the second frame 128. Finally, the first frame 126 and the second frame 128 are displayed in sequence through the source driver 104. Before displaying the first frame 126 and the second frame 128, the following frame can be stored in the memory 110 of the timing controller 102.

The display method of the present invention is detailed in the following description. As shown in FIG. 4, the display method of the active matrix display includes following steps:

Step S10: provide image data, and the image data includes a plurality of pixel data rows, wherein each pixel data row corresponds to a scanning signal;

Step S20: divide the image data into a first image section and a second image section, wherein at least one of the pixel data rows includes a first pixel data segment and a second pixel data segment, the first pixel data segment is located in the first image section, and the second pixel data segment is located in the second image section;

Step S30: insert a first black frame section and a second black frame section respectively into the first image section and the second image section, so that the first image section and the first black frame section form a first frame, and the second image section and the second black frame section form a second frame, wherein the first black frame section and the second image section are located in a same display section, and the second black frame section and the first image section are located in a same display section;

Step S40: display the first frame; and

Step S50: display the second frame so as to display the image data.

Figure 5:
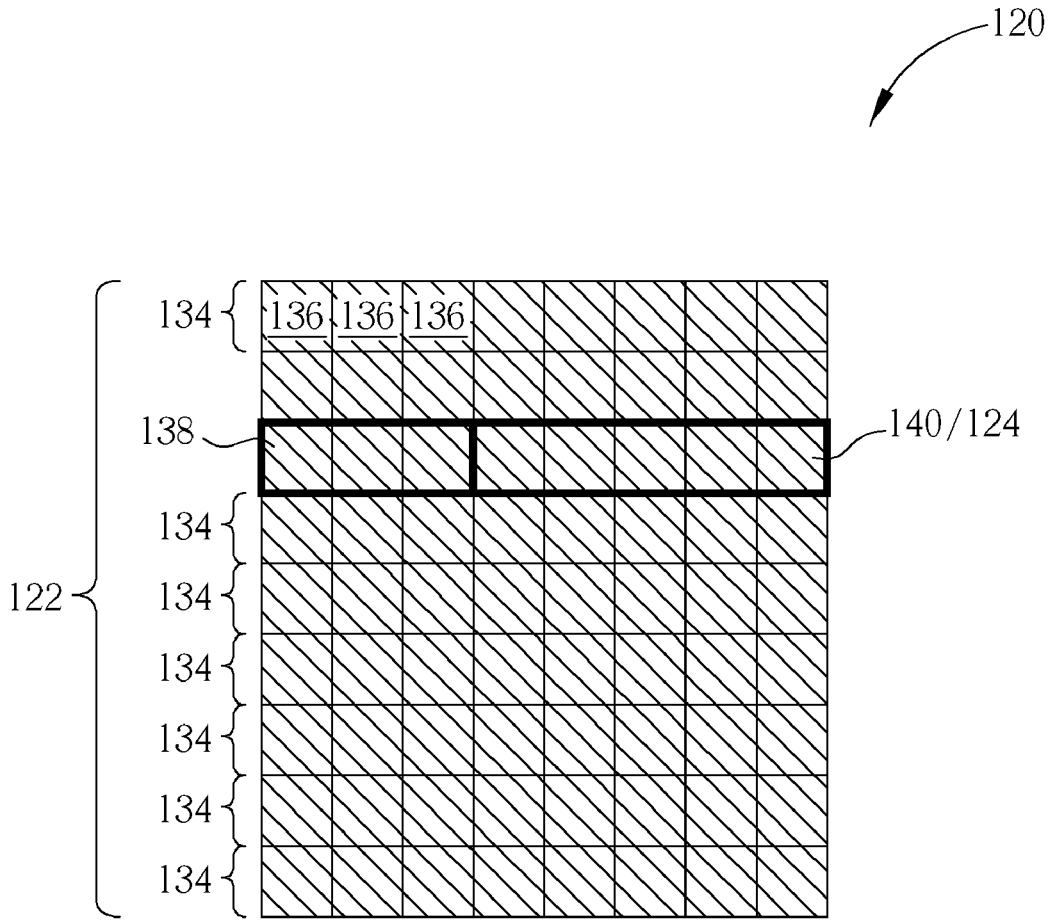
FIG. 5 is a schematic diagram illustrating the dividing step for the image data of the first embodiment of the present invention.

Refer to FIG. 5, and refer to FIG. 2 and FIG. 4 together FIG. 5 is a schematic diagram illustrating the dividing step for the image data of the first embodiment of the present invention. As shown in FIG. 5, in step S10, the image data 120 is data with images of a whole frame, and the motion frames can be displayed through displaying a plurality of image data 120 continuously. In addition, each pixel data row 134 is composed of a plurality of pixel data 136, and the pixel data 136 in a same pixel data row 134 are displayed by the pixels on a same gate line 114. The scanning signal corresponding to the pixel data row 134 is transmitted by the gate line 114. In this embodiment, the image data 120 is inputted into the timing controller 102.

Then, in the step S20, the image data 120 inputted into the timing controller 102 can be divided into the first image section 122 and the second image section 124 by the timing controller 102. The method for dividing the image data 120 can utilize the memory 110 in the timing controller 102 to store the second image section 124 in the image data 120, and uses the first image section 122 to perform the following step. In this embodiment, at least one of the pixel data rows 134 is divided into a first pixel data segment 138 and a second pixel data segment 140. The first pixel data segment 138 and the other pixel data rows 134 without being divided are located in the first image section 122, and the second pixel data segment 140 is located in the second image section 124.

Figure 6:
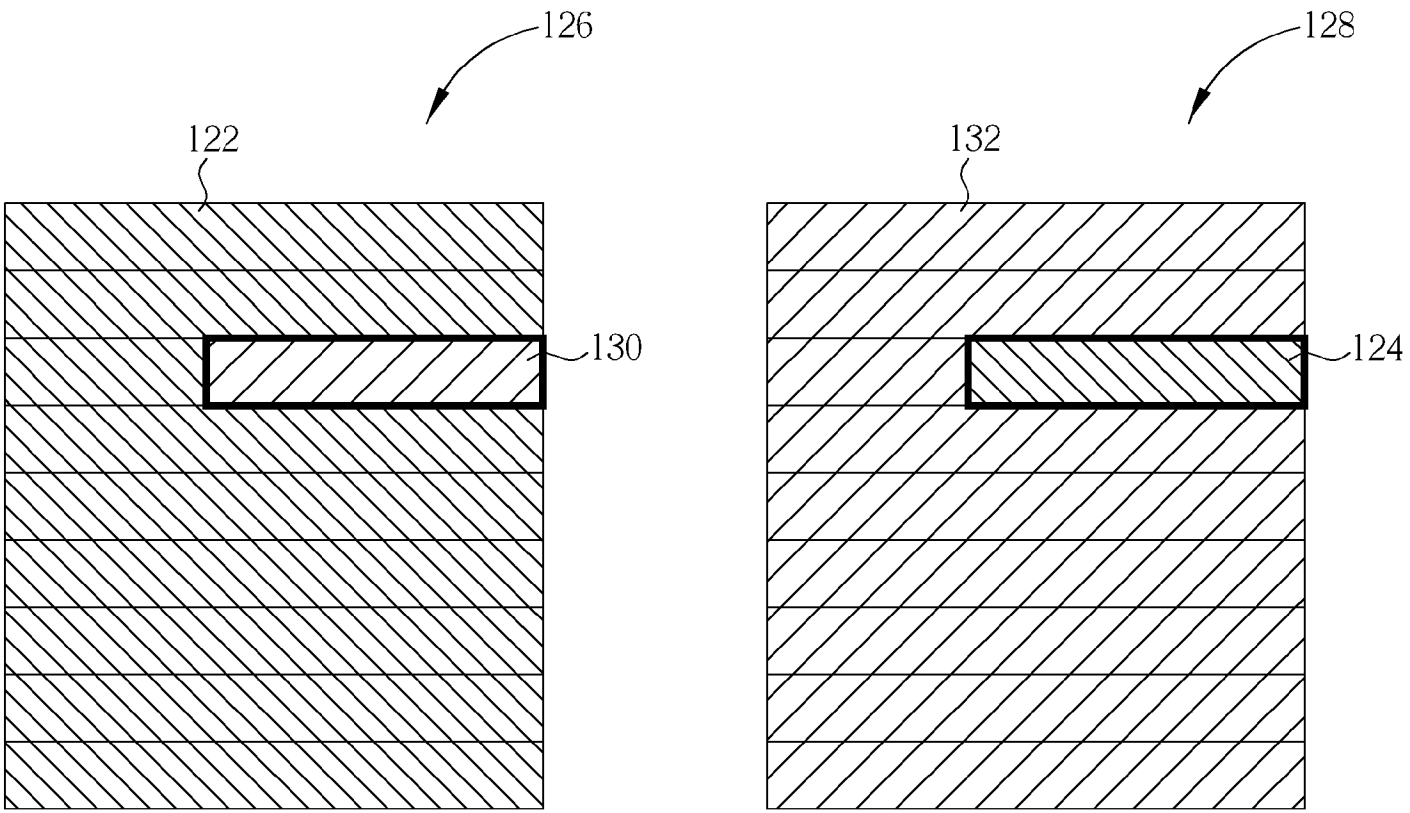
FIG. 6 is a schematic diagram illustrating the first frame and the second frame of the first example.

Refer to FIG. 6, and refer to FIG. 2 and FIG. 4 together FIG. 6 is a schematic diagram illustrating the first frame and the second frame of the first example. As shown in FIG. 6, next, in the step S30, the timing controller 102 can insert the first black frame section 130 and the second black frame section 132 respectively into the first image section 122 and the second image section 124 so as to respectively form the first frame 126 and the second frame 128. It should be noted that the above-mentioned step of storing the second image section 124 into the memory 110 of the timing controller 102 also can be performed after inserting the second black frame section 132 and forming the second frame 128 with the second black frame section 132 and the second image section 124, and then, the second frame 128 is stored in the memory 110.

Then, in the step S40, the timing controller 102 outputs the first frame 126 to the source driver 104, and then, the first frame 126 is inputted to the display panel 108 through the source driver 104. Meanwhile, the timing controller 102 also generates a first scanning signal, and the first scanning signal is inputted to the display panel 108 through the gate driver 106 for displaying the first frame 126. It should be noted that before displaying the first frame 126, the second frame 128 is stored at the memory 110 of the timing controller 102 so as to help to perform the following step S50.

Finally, in the step S50, the timing controller 102 inputs the second frame 128 stored in advance to the display panel 108. Such as the display method for the first frame 126, the second frame 128 can be displayed in the same method. The timing controller 102 also generate a second scanning signal set, and the second scanning signal set is inputted to the display panel 108 through the gate driver 106 for displaying the second frame 128. Therefore, the image data 102 can be displayed through displaying the first frame 126 and the second frame 128 in sequence. In this embodiment, the time interval of the first scanning signal set is the same as the time interval of the second scanning signal set. The present invention is not limited to this, and the time intervals of the first scanning signal set and the second scanning signal set can be adjusted according to the real requirements.

It should be noted that the present invention utilizes the timing controller to divide the image data, and inserts the black frame section respectively into each image section, so that the frames being displayed all include the image section with brightness and the black frame section without brightness. The situation of the brightness difference between the adjacent display frames can be reduced so as to solve the problem of motion image flicker, motion blur and image residue. The memory of the timing controller can be utilized to store the second frame that has not been displayed yet, so that the first frame and the second frame can be outputted to the display panel through the source driver. The image data can be displayed. Accordingly, the present invention only require a gate driver to display each frame with partial black frame and partial image so as to achieve the effect of inserting the black frame into the image data and to avoid increasing manufacturing cost due to adding extra gate drivers.

Figure 7:
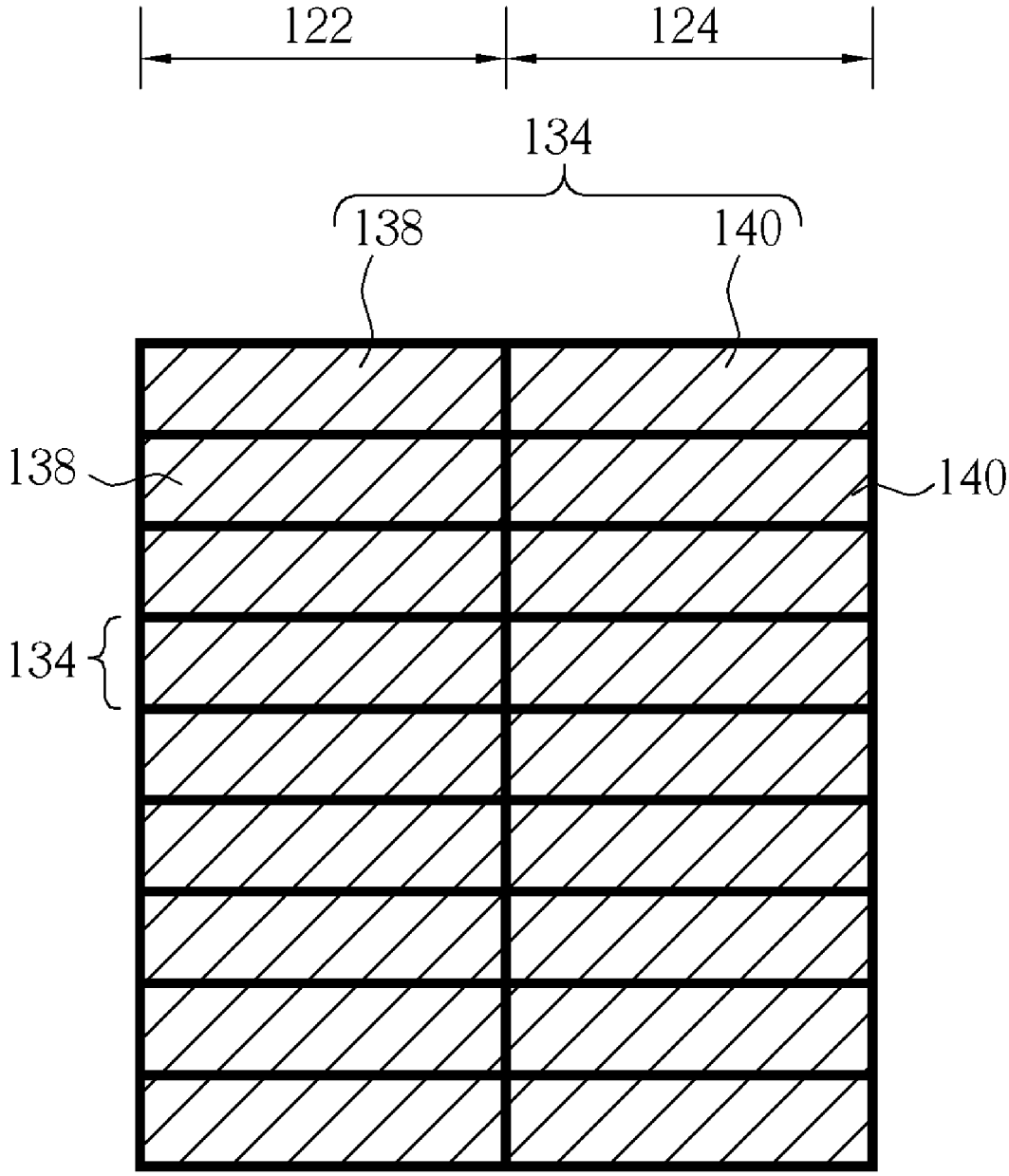
FIG. 7 is a schematic diagram illustrating a second example for dividing the image data of the present invention.

Furthermore, the first image section or the second image section of the present invention is not limited to only include partial segment of one of the pixel data row, and each pixel data row also can be divided into two pixel data segments. Refer to FIG. 7, which is a schematic diagram illustrating a second example for dividing the image data of the present invention. As shown in FIG. 7, as compared with the first example, each pixel data row 134 of this example is divided into a first pixel data segment 138 and a second pixel data segment 140. The first pixel data segments 138 of the pixel data rows 134 have a same length, and the second pixel data segments 140 of the pixel data rows 134 also have a same length. The first pixel data segment 138 is located in the first image section 122, and the second pixel data segment 140 is located in the second image section 124.

Figure 8:
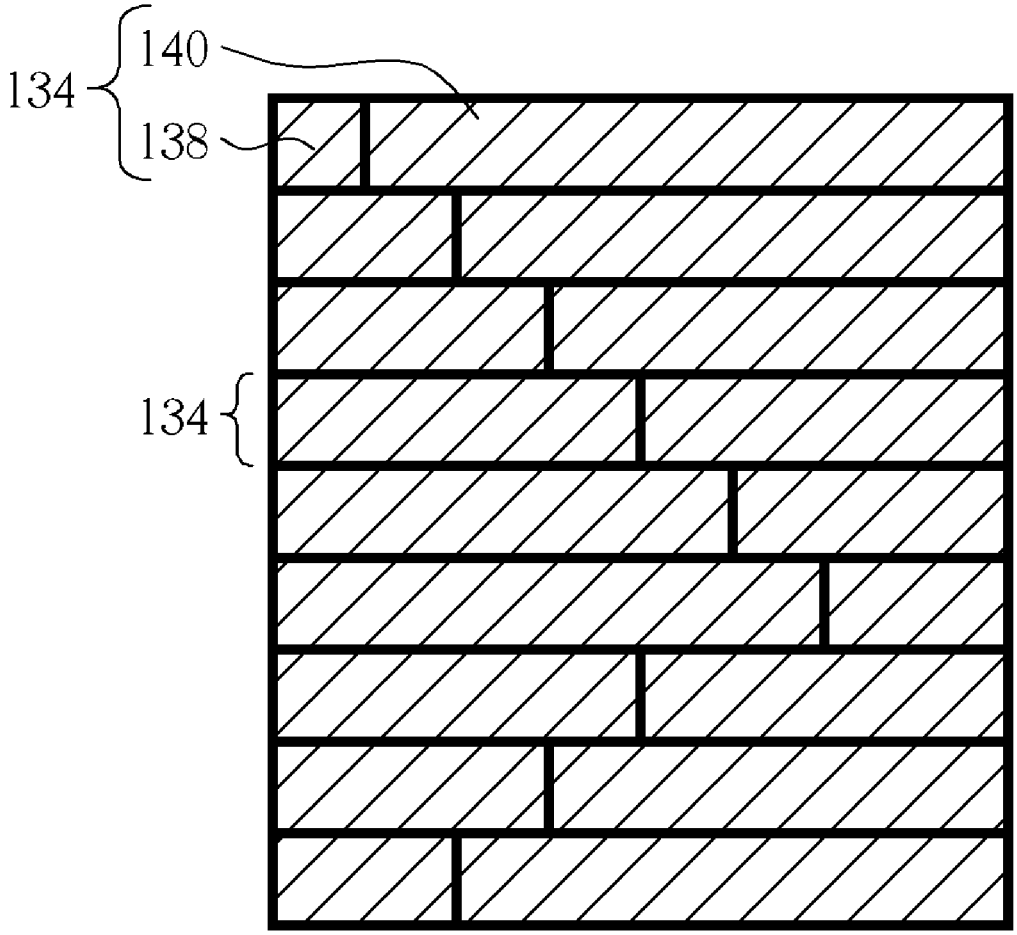
FIG. 8 is a schematic diagram illustrating a third example for dividing the image data of the present invention.

However, the present invention is not limited to the first pixel data segments having the same length. Refer to FIG. 8, which is a schematic diagram illustrating a third example for dividing the image data of the present invention. As shown in FIG. 8, as compared with the second example, the first data segments 138 of the pixel data rows 134 of this example have different lengths, and the second data segments 140 of the pixel data rows 134 of this example also have different lengths, but not limited to this. At least two of the first pixel data segments 138 can have different lengths, and the other first pixel data segments 138 have a same length.

Figure 9:
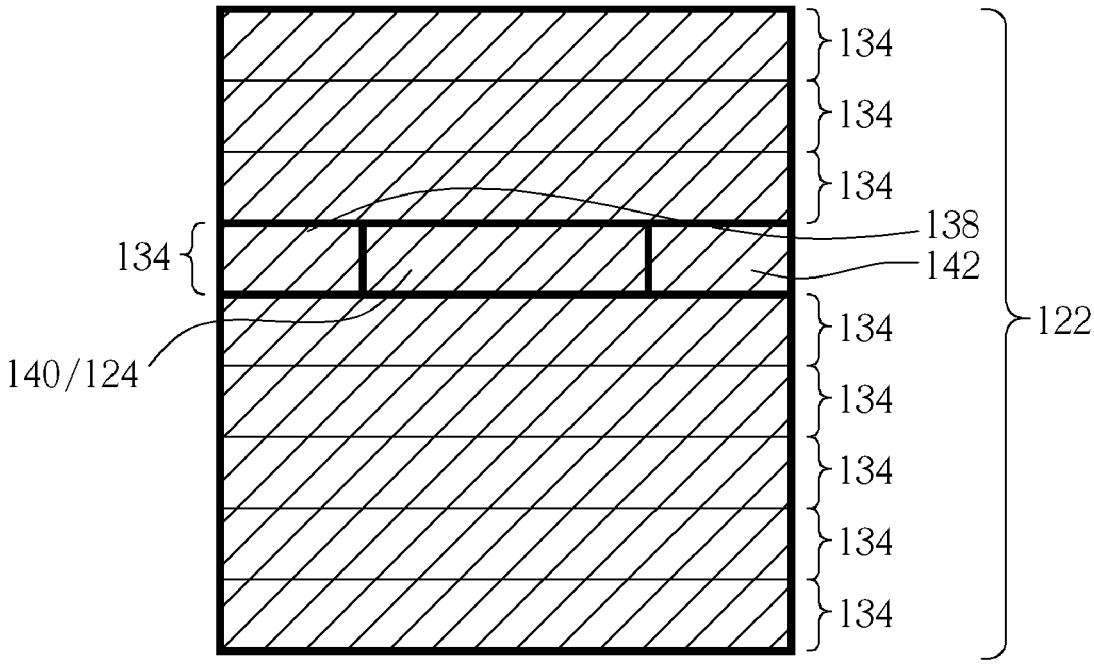
FIG. 9 is a schematic diagram illustrating a fourth example for dividing the image data of the present invention.

In addition, refer to FIG. 9, which is a schematic diagram illustrating a fourth example for dividing the image data of the present invention. As shown in FIG. 9, as compared with the first example, at least one of the pixel data rows 134 of this example not only can be divided into the first pixel data segment 138 and the second pixel data segment 140, but also can further be divided into a third pixel data segment 142. The third pixel data segment 142 is located at the other side of the second pixel data segment 140 opposite to the first pixel data segment 138. The second pixel data segment 140 is located in the second image section 124, and the first pixel data segment 138, the third pixel data segment 142 and the other pixel data rows 134 without being divided are located in the first image section 122.

Figure 10:
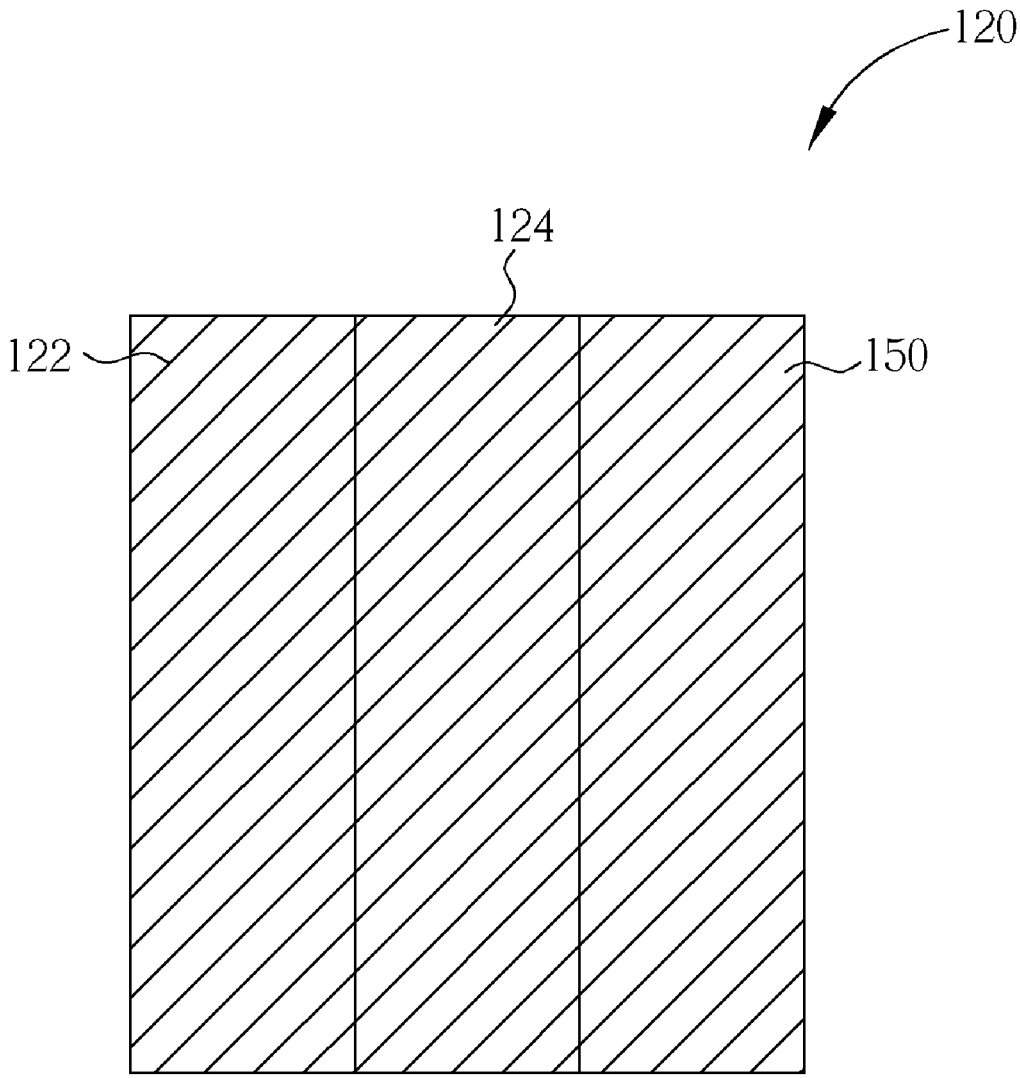
FIG. 10 and FIG. 11 are schematic diagrams illustrating a display method on the active matrix display according to a second embodiment of the present invention.
Figure 11:
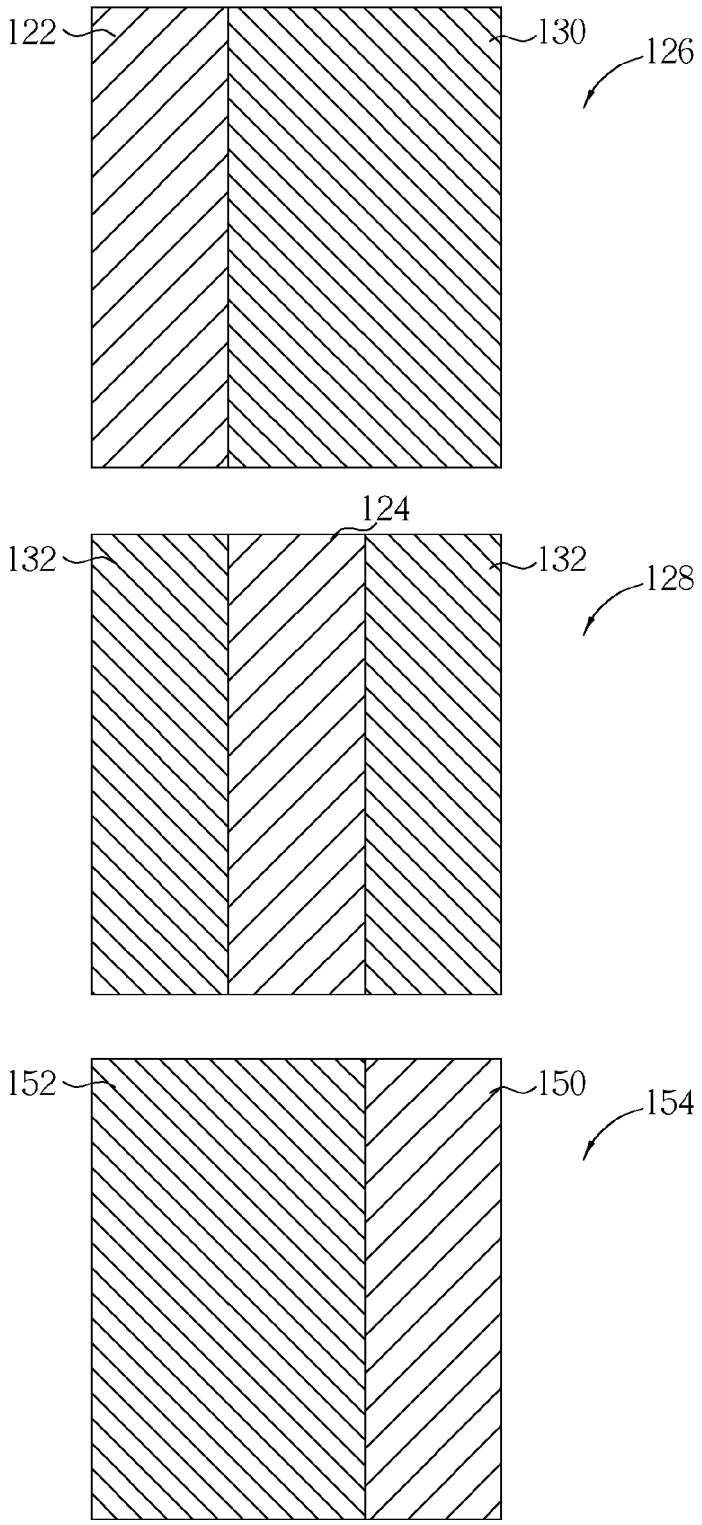

The image data of the present invention is not limited to only be divided into two image sections, and the image data of the present invention also can be divided into a plurality of image sections. Refer to FIG. 10 and FIG. 11, and refer to FIG. 2 and FIG. 4 together. FIG. 10 and FIG. 11 are schematic diagrams illustrating a display method on the active matrix display according to a second embodiment of the present invention. In order to clearly compare this embodiment and the first embodiment, the steps of this embodiment that are the same as the steps of the first embodiment are not detailed redundantly, and the same steps are labeled with the same signs. As shown in FIG. 10, as compared with the first embodiment, the step S20 of dividing the image data in this embodiment not only divides the image data 120 into the first image section 122 and the second image section 124, but also divides the image data 120 further into a third image section 150. As shown in FIG. 11, in the step S30, besides inserting the first black frame section 130 and the second black frame section 132, the timing controller 102 further inserts a third black frame section 152. Accordingly, the first image section 122 and the first black frame section 130 constitute a first frame 126, and the second image section 124 and the second black frame section 132 constitute a second frame 128. The third image section 150 and the third black frame section 152 constitute a third frame 154. In addition, the first black frame section 130 is located at a display section the same as the second image section 124 and the third image section 150. The second black frame section 132 is located at a display section the same as the first image section 122 and the third image section 150. The third black frame section 152 is located at a display section the same as the first image section 122 and the second image section 124. Finally, after the step S50, this embodiment further includes performing a step S60 to display the third frame 154, so that the image data 120 can be displayed.

As the above-mentioned description, the present invention utilizes the timing controller to divide the image data into at least two image sections and to insert the black frame sections respectively into the image sections so as to respectively form a frame. Therefore, the frame being displayed include a image section with brightness and a black frame section without brightness so as to reduce the overly large difference in brightness between the two adjacent display frames, and the problems of motion image flicker, motion blur and image residue can be solved. Furthermore, the memory of the timing controller is utilized to store the following frame that has not been displayed yet, and then, the frames are displayed in sequence through the source driver. Therefore, to display each frame with partial black frame and image only requires a gate driver so as to avoid increasing manufacturing cost due to adding extra gate drivers.

Those skilled in the art will readily observe that numerous modifications and alterations of the device and method may be made while retaining the teachings of the invention.

What is claimed is:

1. A display method on an active matrix display, comprising:

providing image data, and the image data comprising a plurality of pixel data rows, wherein each pixel data row corresponds to a scanning signal;

dividing the image data into a first image section and a second image section, wherein at least one of the pixel data rows comprises a first pixel data segment and a second pixel data segment, the first pixel data segment is located in the first image section, and the second pixel data segment is located in the second image section;

inserting a first black frame section and a second black frame section respectively into the first image section and the second image section, so that the first image section and the first black frame section form a first frame, and the second image section and the second black frame section form a second frame, wherein the first black frame section and the second image section are located in a same display section, and the second black frame section and the first image section are located in a same display section;

displaying the first frame; and displaying the second frame so as to display the image data.

2. The displaying method of claim 1, further comprising storing the second frame before displaying the first frame.

3. The displaying method of claim 2, wherein the second frame is stored at a memory of a timing controller.

4. The displaying method of claim 1, wherein the image data is inputted into a timing controller.

5. The displaying method of claim 4, wherein the step of dividing the image data is performed in the timing controller.

6. The displaying method of claim 4, wherein the step of inserting the first black frame section and the second black frame section is performed in the timing controller.

7. The displaying method of claim 1, wherein the first frame and the second frame are inputted to a display panel through a source driver so as to display the image data.

8. The displaying method of claim 1, further comprising generating a first scanning signal set to be inputted to a display panel through a gate driver for displaying the first frame, and generating a second scanning signal set to be inputted to the display panel through the gate driver for displaying the second frame during displaying the first frame.

9. The displaying method of claim 8, wherein the time interval of the first scanning signal set is the same as the time interval of the second scanning signal set.

10. The displaying method of claim 1, wherein at least one of the pixel data rows is further divided into a third pixel data segment adjacent to the second pixel data segment, and the third pixel data segment is located in the first image section.

11. The displaying method of claim 1, wherein each pixel data row is divided into the first pixel data segment and the second pixel data segment, the first pixel data segments are located in the first image section, and the second pixel data segments are located in the second image section.

12. The displaying method of claim 11, wherein in the pixel data rows, at least a part of the first pixel data segments have different lengths.

13. The displaying method of claim 1, wherein the image data is further divided into a third frame section in the step of dividing the image data.

14. The displaying method of claim 13, further comprising inserting a third black frame section in the step of inserting the first black frame section and the second black frame section, and the third black frame section and the third frame section forming a third frame.

15. The displaying method of claim 14, wherein the third black frame section, the first image section and the second image section are located in a same display section.

* * * * *